US007387215B1

(12) United States Patent
Grigsby, Sr.

(10) Patent No.: US 7,387,215 B1
(45) **Date of Patent: *Jun. 17, 2008**

(54) FOLDABLE END FRAME CONTAINER

(75) Inventor: John M. Grigsby, Sr., Marietta, GA (US)

(73) Assignee: North American Container Corporation, Mableton, GA (US)

( * ) Notice: Subject to any disclaimer, the term of this patent is extended or adjusted under 35 U.S.C. 154(b) by 223 days.

This patent is subject to a terminal disclaimer.

(21) Appl. No.: 11/294,993

(22) Filed: Dec. 6, 2005

(51) Int. Cl.
*B65D 6/16* (2006.01)
*B65D 6/00* (2006.01)
*B65D 8/14* (2006.01)

(52) U.S. Cl. ..... 217/45; 220/6; 108/56.1

(58) Field of Classification Search ..... 220/1.5, 220/6, 7; 217/13–15, 45–47; 108/56.1
See application file for complete search history.

(56) References Cited

U.S. PATENT DOCUMENTS 2,498,414 A 2/1950 Gondar
3,139,205 A 6/1964 Haubrich
3,402,845 A 9/1968 Lars
3,735,713 A 5/1973 Glassmeyer
4,832,256 A 5/1989 Grigsby
5,810,186 A 9/1998 Lam
5,813,555 A 9/1998 Grigsby, Sr.
5,829,189 A 11/1998 Grigsby, Sr.
6,250,050 B1 6/2001 Grigsby, Sr.
6,279,763 B1 * 8/2001 Bush ..... 211/195
6,585,126 B1 7/2003 Grigsby, Sr.
6,938,557 B1 9/2005 Grigsby, Jr.
7,011,223 B1 * 3/2006 Grigsby, Sr. ..... 217/45

* cited by examiner

*Primary Examiner*—Anthony D. Stashick
*Assistant Examiner*—Harry A Grosso
(74) *Attorney, Agent, or Firm*—Baker Donelson Bearman Caldwell & Berkowitz PC

(57) ABSTRACT

A frame container (10) for packing heavy durable goods in which a base (12) includes two end frames (14, 16) connected by pairs of opposing side diagonals (40) pinned at first ends to the base and at second ends (42) to the end frames. Each pair of opposing side diagonals (40) pivot between a first position aligned with the base and the second ends near respective ends of the base and an erected second position whereby the side diagonals are disposed at an oblique angle relative to the base with the second ends of the pair of side diagonals remote from the respective ends of the base for enclosing heavy durable goods within the container.

26 Claims, 4 Drawing Sheets

FOLDABLE END FRAME CONTAINER

TECHNICAL FIELD

The present invention relates to frame containers for packing, shipping and storing heavy equipment. More particularly, the present invention relates to frame containers having foldable end frames for readily handling on packing lines of manufacturers of heavy equipment.

BACKGROUND OF THE INVENTION

Heavy durable goods, such as riding lawn mowers, outboard motors, and the like, are typically packaged in containers for packaging, storage, and shipping. Containers useful for enclosing heavy durable goods include wood cleated corrugated paperboard containers, wood cleated crates, and metal frame crates. These containers provide top load capacity, by which vertical loading on the container transfers by side members to the base pallet that holds the heavy durable good. Corrugated paperboard containers also provide protection for the contents from dust and incidental contact. Cleated crates, whether of metal or of wood, are generally open, and so the contents need to be separately enclosed such as with plastic film, sheeting, or the like, to protect from dirt and dust.

Conventional wood cleated crates for packaging heavy durable goods typically are comprised of separate loose sides, ends, tops, and bases. These components are known in the trade of "crate shook". Two sides and two ends are used together with a base and a top for assembly of a wood cleated crate. The separate components are stapled or nailed together at the users assembly lines during packaging of the heavy goods manufactured by the user of the crates. The nailing and stapling however requires much assembly line labor, fasteners, and time. While the assembly line continues to produce heavy articles for packaging, crating line personnel must keep up to prevent backups or being overwhelmed with products coming from the assembly line.

Recent improvements have been made to address problems with the use of crate shook. U.S. Pat. No. 5,829,189 describes a wood cleated crate having hinged-corners that define a unitary body for the cleated crate. U.S. Pat. No. 6,250,050 describes a wood cleated corrugated paperboard container having wing ends that define portions of opposing sides and an end of the crate, which portion are readily attachable to a pallet.

While these containers have reduced the number of components necessary for assembly of a cleated crate, other structures may gainfully provide the benefits of reduced number of components and simplicity of assembly while reducing shipping and storage space to hold the components pending usage at the manufacturing facility. As an alternative to single use containers, some manufacturers of heavy durable goods are using returnable containers. One such returnable container for heavy durable goods is manufactured with steel framing members. The pallet or base of the container includes projecting lugs at the corners. The lugs receive end panels. The pallet and the end panels interlock with detachable pins.

While these types of returnable container have met with some acceptance, there are drawbacks to their use. The end panels must be held while the side members are installed. The connections permit the end panels to move laterally, which lessens the structural rigidity of the container and restricts the containers from stacked loading for storage in warehouses or in trucks for shipping. The loose pins and detachable separate components often are lost and not returned. This results in all of the parts not be available when the returned container is placed on the assembly line of the manufacturer for re-use. To avoid a line stoppage, the returned containers must be inspected and damaged parts repaired or replaced and missing parts provided from an inventory of spare components.

Accordingly, there is a need in the art for an improved cleated crate. It is to such that the present invention is directed.

BRIEF SUMMARY OF THE INVENTION

The present invention solves the above-described problems in the prior art by providing a frame container for packing, shipping, and storing heavy articles in which a supporting base includes opposing ends and opposing sides. Two pairs of opposing side diagonals pivotally connect at respective first ends to respective sides of the base remote from the opposing ends of the base. Opposing end frames pivotally connect to respective second ends of the respective pair of opposing side diagonals. Each pair of opposing side diagonals pivot between a first position aligned with the base and the second ends near respective ends of the base and a second pivoted position whereby the side diagonals are disposed at an oblique angle relative to the base with the second ends of the pair of side diagonal remote from the respective ends of the base and towards the opposing end of the base. The end frames thereby pivot from a shipping position against the base, a first loading position with the end frames pivoted outwardly of the respective end, a second loading position with the end frame pivoted outwardly of the base remote from the respective end and towards the opposing end of the base, and an erected position with the side diagonal at an oblique angle to the base and the frame member extending from the respective end of the base for enclosing heavy equipment within the container. The end frames thereby pivot between a knocked-down position lying against the supporting base and an erected position extending in a first direction from the base for containing heavy durable goods on the base.

Objects, advantages and features of the present invention will become apparent from a reading of the following detailed description of the invention and claims in view of the appended drawings.

DETAILED DESCRIPTION OF THE PREFERRED EMBODIMENTS

Figure 1:
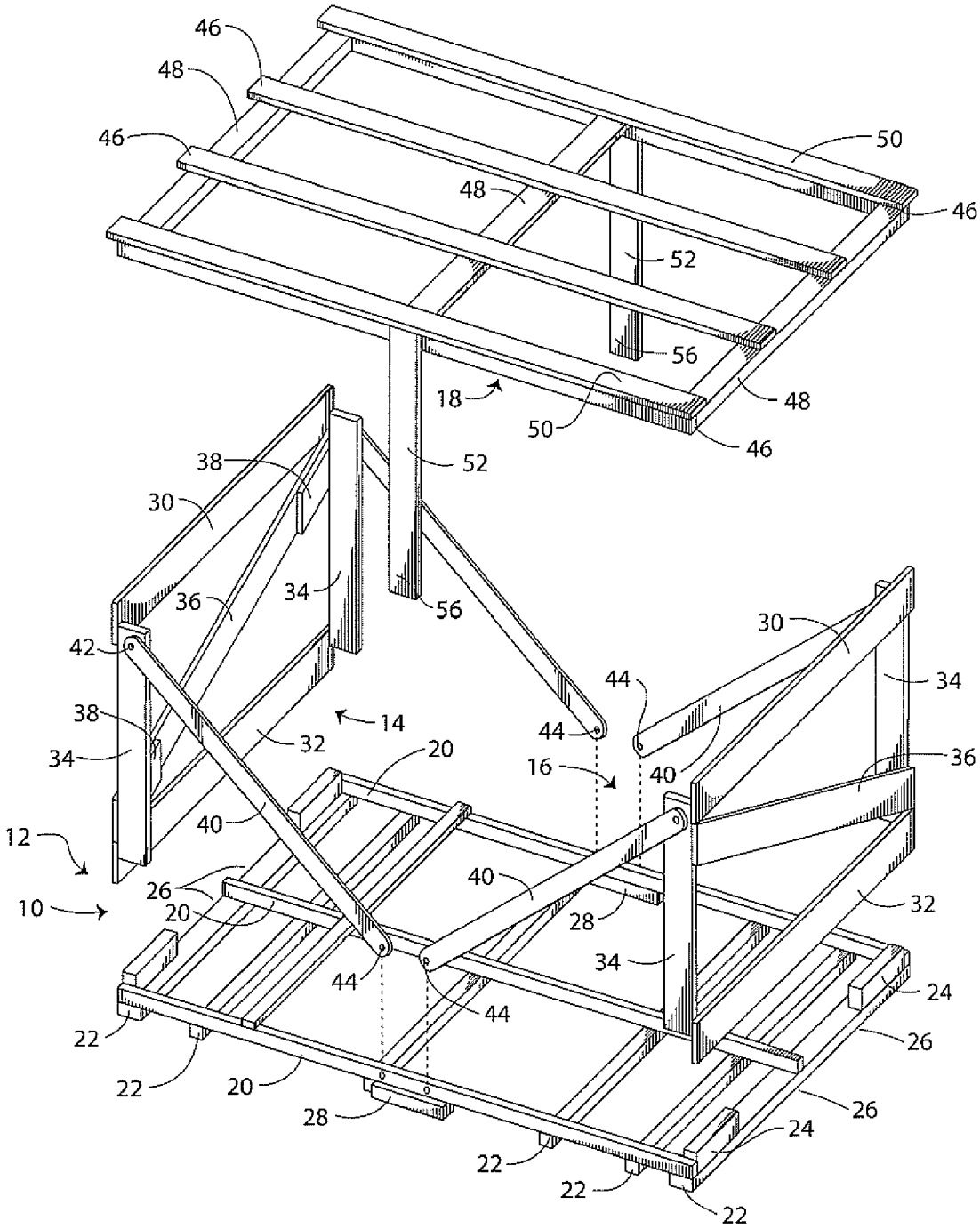
FIG. 1 illustrates in perspective exploded view a first embodiment of a frame crate according to the present invention.

Referring now in more detail to the drawings, in which like numerals indicate like parts throughout the several views, FIG. 1 illustrates in exploded perspective view a frame crate 10 of the present invention, in which a first base 12 pivotally connects to opposing pivotable end frames 14, 16, with a second opposing base or top frame 18 received on upper ends of the end frames to define the frame crate 10.

The base 12 includes a plurality of spaced-apart parallel stringers 20. The stringers 20 interconnect with a plurality of spaced-apart transverse members 22. The transverse members 22 connect at the opposing distal ends of the stringers and at intermediate spacing. Corner blocks 24 connect to the transverse members 22 at the opposing ends of the base 12. The corner blocks 24 define gaps 26 for entry of forklift blades for picking up a packaged article in the frame crate 10. A pair of support blocks 28 connect to the outermost stringers 20 on opposing sides of the base 12.

The opposing end frames 14, 16 in the illustrated embodiment are mirror images. The end frame 14 includes a transverse upper end member 30 and an opposing transverse lower end member 32. The terms "upper" and "lower" are used to indicate vertical spacing relative to the base 12 when the frame crate 10 is erected for use in packaging goods. The term "lower" refers to the portion of the end frames 14, 16 closer to the base 12. When erected for use, side posts 34 connect to the aligned distal ends of the upper and lower end members. A diagonal member 36 connects at an angle to the opposing side posts 34 between the upper end member 30 and the lower end member 32. Although not illustrated, the end frame 14 can include a second diagonal crossed relative to the diagonal 36. The pair of diagonals are preferably joined in the crossed middle portions. In the illustrated embodiment, a pair of support members 38 connect to the diagonal 36 adjacent the inward sides of the side post 34. The support members 38 define a notch with the extending the portion of the diagonal to rigidly hold the side posts 34. A pair of side diagonals 40 pivotally connect at a first end 42 to the respective side posts 34 adjacent the upper end member 30. An opposing end 44 pins to the respective outermost stringer 20 adjacent the support block 28 on opposing sides of the base 12. The end frames 14, 16 accordingly pivot at the pin connection at the end 42 of the diagonal 40 and at the pin connection at the end 44, for purposes discussed below.

The top frame 18 assembles from a plurality of stringers 46 that are spaced apart substantially the width of the base 12. The stringers 46 interconnect with transverse members 48. In the illustrated embodiment, the outermost stringers 46 include a cap member 50 which preferably extend the length of the base 12. In the illustrated embodiment, the cap member 50 extends laterally of the respective stringer 46 and defines a recess with the stringer. A pair of intermediate supports 52 pivotally connect on opposing sides of the top frame 18 intermediate the opposing distal ends of the outermost stringers 46. The intermediate supports 52 pivot from a first position adjacent the respective top cap 50 to a second position substantially perpendicular between the top frame 18 and the base 12. The distal end 56 of the intermediate support 52 secures with a fastener to the respective outermost stringer 20 of the base 12.

Figure 2:
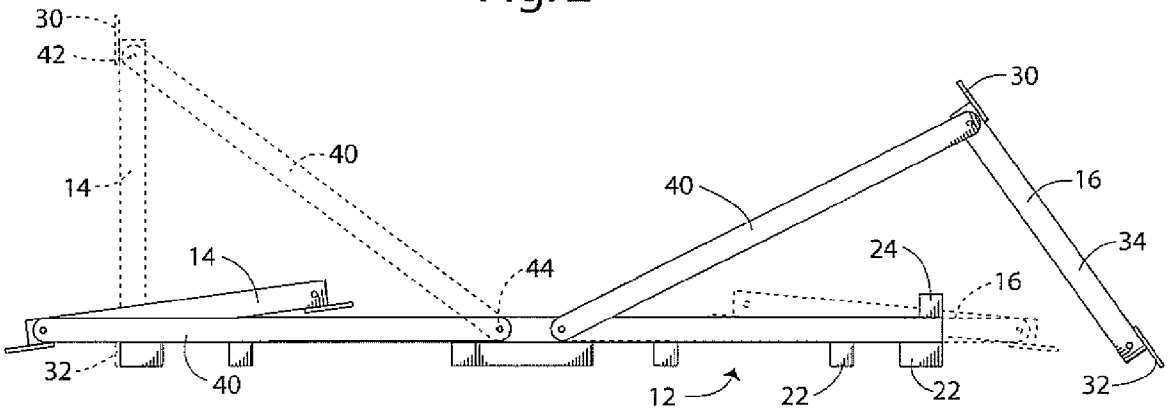
FIG. 2 shows in side view the crate shown in FIG. 1 illustrating a knocked-down position for shipping and storing and erection of frames prior to use of the container for containing heavy durable goods.

FIG. 2 shows a side view of the frame crate 10 in an intermediate position between a knocked-down position for shipping and storing and an erected position with the end frames erected prior to use of the frame crate 10 for containing heavy durable goods. In FIG. 2, the left portion illustrates the end frame 14 in the knocked-down position. The diagonal 40 is parallel to the adjacent stringer 20. The side posts 34 rest on an end portion of the stringer 20, whereby the end frames 14, 16 (illustrated in phantom in knocked-down view in FIG. 2) lies on the base 12. The end frame 14 is illustrated in phantom in the erected position for holding a heavy durable good on the base 12. The end frame 16 is illustrated in a intermediate position between the knocked-down position (illustrated in phantom) and the opposing erected position. The bottom of the side posts 34 contact and bear against an upper surface of the respective outermost stringer 20. The lower end member 34 abuts the end faces of the corner blocks 24 and the end transverse member 22. The lower end members 32 accordingly guide the positioning of the end frames 14, 16 extending upwardly erected on the base 12.

Figure 3:
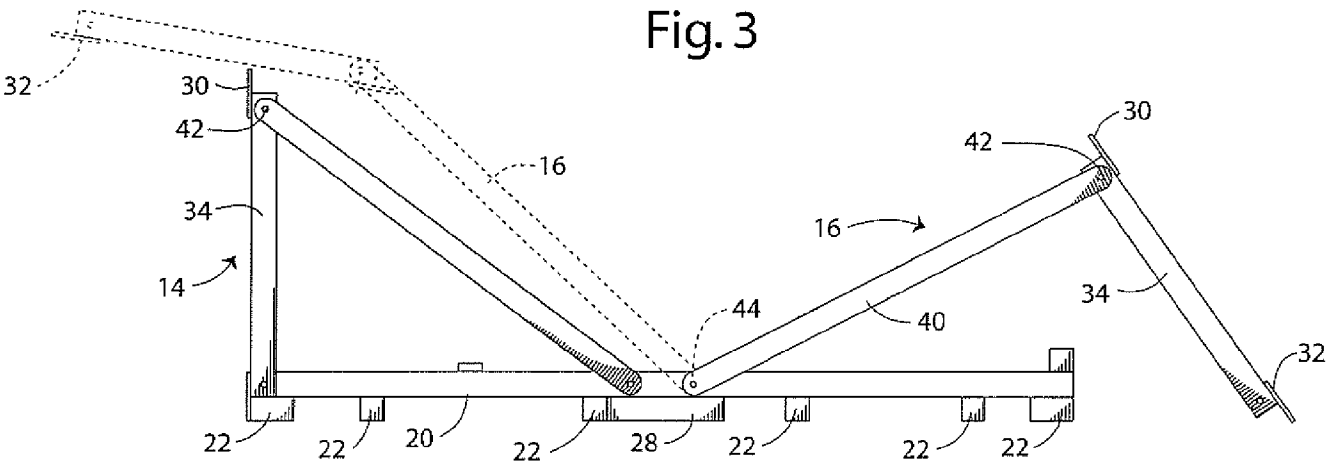
FIG. 3 shows in side view the crate shown in FIG. 2 illustrating the setup of the crate intermediate the knocked-down position shown in FIG. 2 and the erected position shown in FIG. 1.

FIG. 3 shows in side view the frame crate 10 illustrating the erection steps of the frame crate intermediate the knocked-down position as shown in FIG. 2 and the erected position as shown in FIG. 1. The end frame 14 is illustrated in the erected position. The end frame 16 is illustrated in an intermediate position between the knocked-down position and the erected position. The end frame 16 also is shown in phantom pivoted on the side diagonal 40 at its end 44 towards the opposing end frame 14.

Figure 4:
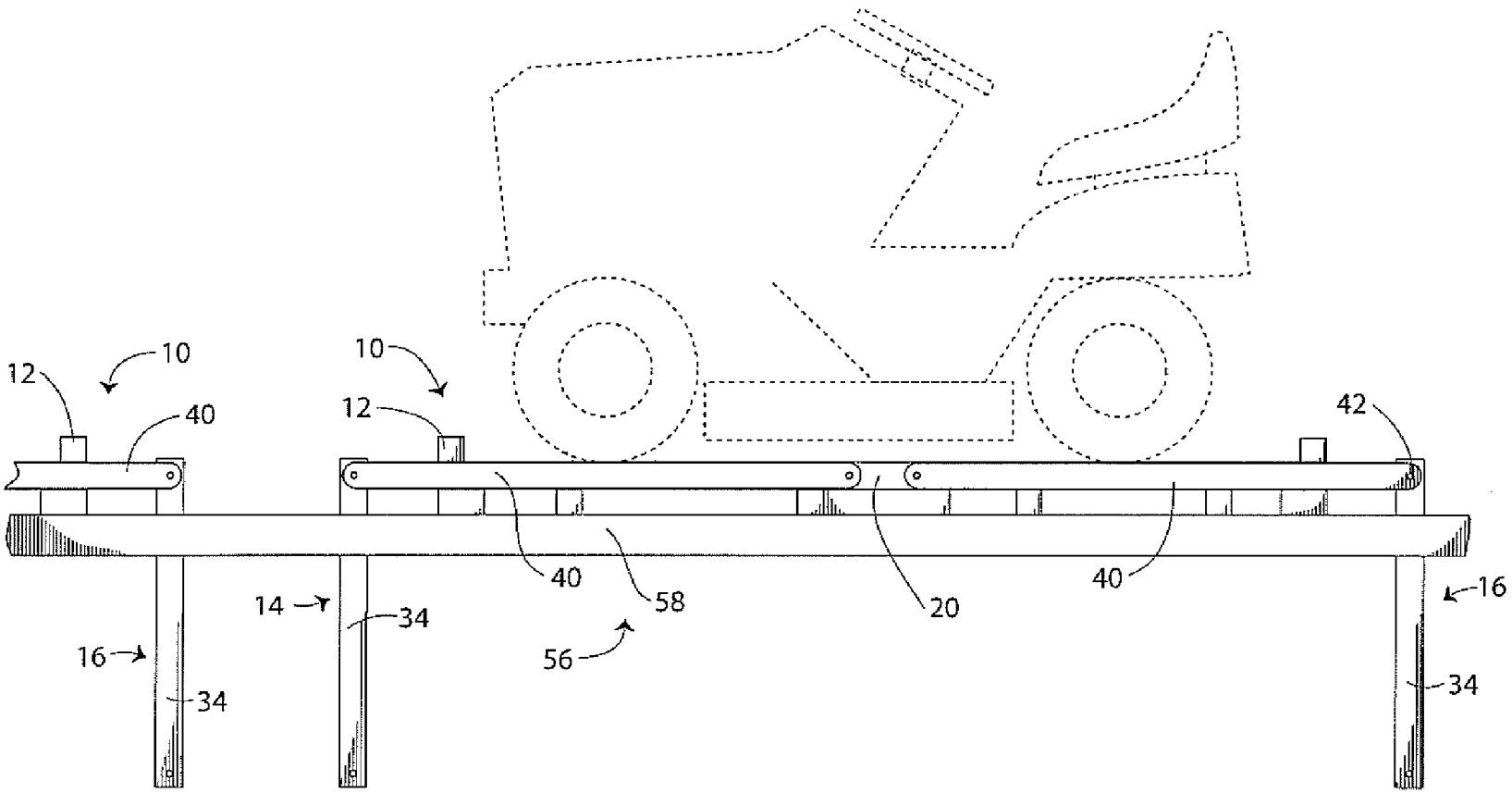
FIG. 4 illustrates in side view the frame crate shown in FIG. 1 on an assembly line using the frame crate for packaging durable goods.

FIG. 4 illustrates a side view of the frame crate 10 shown in FIG. 10 on an assembly line 56 having a conveyer 58. The supports for the conveyer 58 are conventional and not otherwise illustrated. Adjacent frame crates 10 are spaced apart on the conveyer 58. In this application of the present invention, the end frames 14, 16 are pivoted from the knocked-down position (see FIG. 2) for shipping and storage to a packing position with the end frames 14, 16 suspended from the base 12 below the conveyer belt 58. The end frames 14, 16 extend through gaps in the conveyer (not illustrated). This application allows roll-on loading of tractors, for example, on to the base 12 or the use of a overhead crane to lift the heavy durable good (a lawn and garden tractor is illustrated in phantom) from the manufacturing line onto the base 12.

The frame crate 10 of the present invention is used for packaging heavy durable goods for storage and shipping. With reference to FIGS. 1 and 2, the end frames 14, 16 provide double pivoting movement of the end frames relative to the diagonal 40 by pivoting at the distal ends 42 and 44. For shipping and storage of the base 12 from a manufacturer of the frame crate 10 to a manufacturing user of the frame crate 10, the end frames 14, 16 pivot at the connection 42 to the side diagonal 40. This positions the lower end member 32 inwardly and remote from the opposing distal ends of the base 12. The upper end member 30 is disposed longitudinally outwardly of the end of the base 12. The side diagonals 40 pivot at the end 44 to the knocked-down position with the side diagonals adjacent the respective outside stringer 20.

The end frames 14, 16 erect for use by pivoting the diagonals 40 upwardly about the pivot end 44. As illustrated with respect to the end frame 16, as the diagonal 40 is elevated, the end frame 16 pivots at the end 42 outwardly of the end of the base. As the diagonal 40 is elevated, the end frame 16 then moves towards the outside face of the end of the base 12. The side posts 34 rest on upper surfaces of the respective outside stringers 20. The lower end member 32 abuts the distal end of the stringers 20 and the corner blocks 24. The lower end members 32 accordingly cooperate with the corner blocks 24 to position the side posts 34 erected perpendicular to the base 12.

With reference to FIG. 3, the end frame 14 is illustrated in the erected position. The end frame 16 is illustrated in intermediate positions. First, the end frame 16 is shown in an intermediate position with the diagonal 40 pivoted upwardly about the end 44 in order to position the end frame erected at the end of the base 12. Second, in phantom, the end frame 16 is shown pivoted towards the opposing end frame 14 with the end frame 16 pivoted about the end 42 of the diagonal 40 over and outwardly of the end frame 14. This provides an opening or space for placing a heavy durable good on the base 12. For example, the side portion of the base 12 is open when the end frame 16 is pivoted towards the opposing end frame 14, whereby a lawn and garden tractor may readily roll onto the base 12 of the frame crate 10. Following placement of the heavy durable good on the base 12, the end frame 16 pivots to its erected position. This is accomplished by pivoting the diagonal 40 away from the end frame 14 about the end 44 and pivoting the end frame 16 about the end 42 of the diagonal 40.

With reference to FIG. 4, the double pivoting capability of the respective end frames 14, 16 also enables the frame crate 10 of the present invention to be used with elevated conveyers 58 on an assembly line 56, as is found in some manufacturing plants of heavy durable equipment. The end frames 14, 16 suspend through gaps in the conveyer 58, leaving the base 12 open for roll on or overhead crane placement of the article on the base 12. The side diagonals 40 readily pivot at the ends 44 in order to raise the end frames 14, 16 from the suspended positions to the erected position as discussed above with respect to FIG. 2.

After attaching the heavy durable good to the base 12, the top frame 18 is readily installed. Returning to FIG. 1, the intermediate supports 52 pivot downwardly from the top frame. The upper ends of the side posts 34 receive the top frame 18. The end transverse members 48 of the top frame 18 abut against the upper end members 30 of the opposing end frames 14, 16. The top frame 18 is secured and placed with fasteners such as nails, screws, staples, or the like. The pivotable intermediate supports 52 connect with fasteners to the outermost stringers 20 on the opposing sides of the base 12. The lower end members 32 of the opposing end frames 14, 16 likewise secure with fasteners to the corner blocks 24 to rigidly lock the end frames 14, 16 in the fixed erected position.

It is to be appreciated that an alternate embodiment of the present invention may readily be made in which the end frames 14, 16 pivot from the opposing base or top frame 18. In this second embodiment, the opposing ends 14, 16 pivotally attach to the top frame 18. The intermediate supports 52 pivotally connect on opposing sides of the base 12. For some assembly lines, use of the base 12 without the opposing ends 14, 16 is more efficient. Generally, this allows the base 12 to be smaller and the ends 14, 16 are not in the way for rolling product onto the base. The opposing base or top frame 18 with the opposing ends 14, 16 is hoisted over the product on the base 12 at the pack line. The intermediate supports 52 pivot from the attachment with the base 12 so that an upper surface of the intermediate supports contact the respective outside stringers 46. The intermediate supports 52 are secured to the top frame 18. In this embodiment, a stop block attaches to each of the opposing outside stringers 46, offset from a line defined by the intermediate supports 52 when perpendicular to the top frame. The stop blocks stop the pivoting of the intermediate supports so that the supports are positioned properly.

However, in other assembly lines, the pack line is elevated. The first embodiment allows the end frames 14, 16 to fold down out of the way through gaps in the conveyer 58, as illustrated in FIG. 4. The product to be packaged in the frame crate 10 then can be easily rolled or hoisted onto the base 12 with the top frame 18 having the intermediate support member 52 to place on the set-up base-side-end crate 10, as illustrated in FIGS. 2 and 3.

Figure 5:
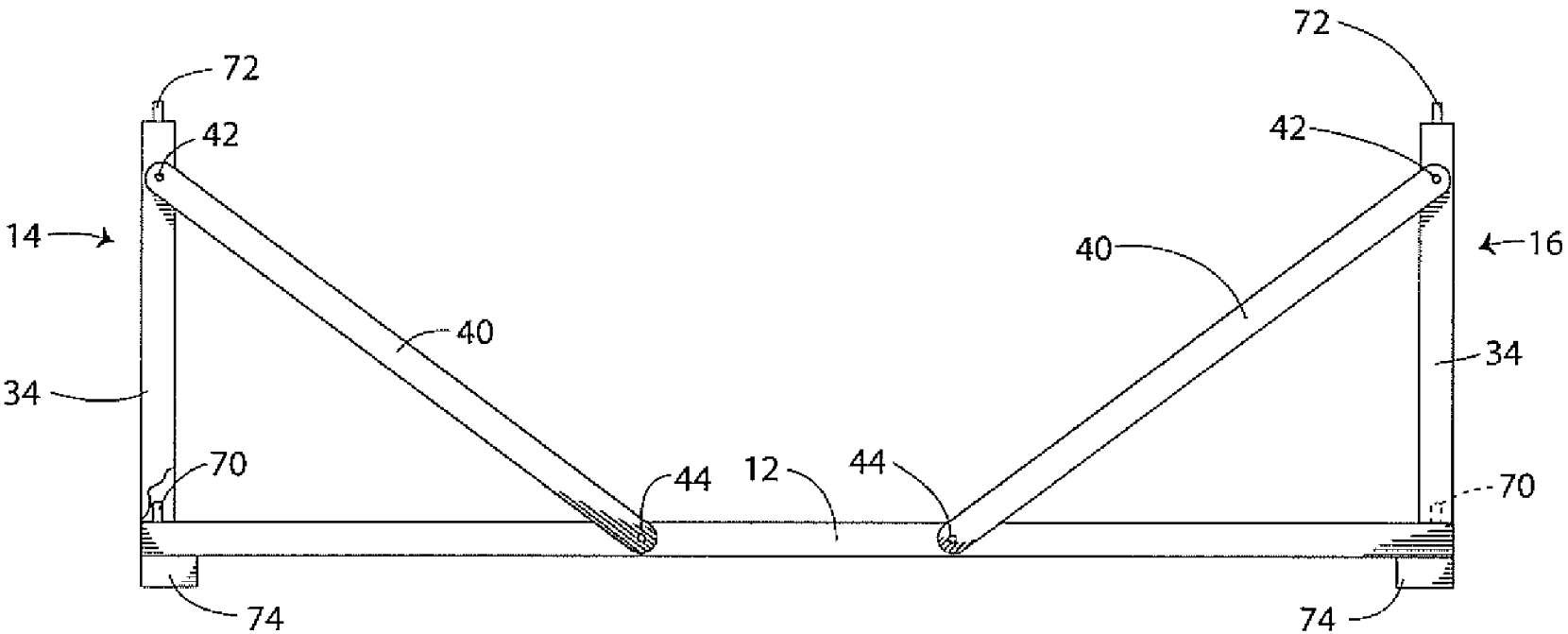
FIG. 5 illustrates in side view on alternate embodiment of the frame crate according to the present invention.

FIG. 5 illustrates an alternate embodiment of the present invention preferably formed of tubular steel members. In this embodiment, an upper surface of the outside stringer includes a receiving post 70 at the respective corners of the base 12. The side posts 34 are tubular members open at the lower end. The receiving posts 70 readily receives the open distal end of the side posts 34 thereby locking the opposing end frames 14, 16 in the erected position. Further, a pin or other fastener readily passes through aligned openings in the support posts 34 and receiving posts 70 to lock the end frames 14, 16 in position. In addition, the upper end of the side posts 34 include a pin 72 extending therefrom along a longitudinal axis of the side posts. Transverse members 22 at the opposing ends of the base 12 define openings in respective end portions. The openings align with the pins 72. In this way, two of the frame crates 10 readily stack together by the openings 74 in the transverse members 22 readily receiving the pins 72 from a lower one of the frame crates. Accordingly, the frame crates of the present invention readily stack, such as for warehouse, storage or truck shipping. In a preferred embodiment, the openings 74 are punched with counter recesses and taper to the hole. In this way, the taper of the counter recessed hole guide the pins to enter the opening.

This specification has described the preferred embodiments of the present invention, including the steps necessary for fabricating the preferred embodiments disclosed. It is to be understood, however, that numerous changes and variations may be made in the construction of the present container within the spirit and scope of the present invention. It should therefore also be understood that the foregoing specification relates only to the preferred embodiments of the present invention and that modifications and changes may be made therein without departing from the scope thereof as set forth in the appended claims.

What is claimed is:

1. A frame container for packing, shipping, and storing heavy articles, comprising:

a first base and an opposing second base, each base having a plurality of spaced-apart parallel stringers connected by a plurality of spaced-apart transverse members at opposing ends and intermediate thereof;

opposing end frames each having a first and second transverse end member interconnected by at least one support diagonal and a pair of opposing side posts connected at distal ends to respective distal ends of the first and second transverse end members;

a pair of opposing side diagonal members joined to each end frame, said diagonal members each pinned in a first end portion to the first base for pivoting relative to the first base and pinned in an opposing end portion to a respective one of the side posts near the connection with the upper end member for pivoting of the end frame, whereby the end frames pivot between a knocked-down position lying against the first base and an erected position extending in a first direction from the first base for containing heavy equipment, guided by the pivoting of the pinned opposing side diagonals.

2. The frame container as recited in claim 1, further comprising a plurality of receiving posts, each attached to a respective one of the opposing ends of the outermost stringers, for receiving a lower end of a respective one of the side posts.

3. The frame container as recited in claim 2, wherein each of the side posts defines an open end for receiving and connecting to a respective one of the receiving posts.

4. The frame container as recited in claim 1, wherein opposing distal end portions of the transverse members at the opposing ends of the base define recesses; and further comprising a pin extending from the side posts along a longitudinal axis thereof, whereby a first and a second one of the frame containers stack by engaging the pins in a vertically lower one of the frame containers in the recesses of a vertically higher one of the frame containers.

5. The frame container as recited in claim 1, further comprising a top frame dimensioned for receipt by the end frames.

6. The frame container as recited in claim 1, wherein the stringers, the transverse members, the transverse upper and lower end member, the support diagonals, and the side posts are wooden members.

7. The frame container as recited in claim 1, wherein the stringers, the transverse members, the transverse upper and lower end member, and the support diagonals are wooden members.

8. The frame container as recited in claim 7, wherein the side posts are elongate tubular members.

9. The frame container as recited in claim 1, wherein the first base comprises a pallet for supporting the heavy equipment within the container between the first and second bases.

10. A frame container for packing, shipping, and storing heavy articles, comprising:

a first base and an opposing second base having opposing ends and opposing sides;

two pairs of opposing side diagonals pivotally connected at respective first ends to respective sides of the first base remote from the opposing ends of the first base;

opposing end frames pivotally connected to respective second ends of the respective pair of opposing side diagonals;

each pair of opposing side diagonals pivotable between a first position aligned with the first base and the second ends near respective ends of the first base and a second pivoted position whereby the side diagonals are disposed at an oblique angle relative to the first base with the second ends of the pair of side diagonal remote from the respective ends of the base and towards the opposing end of the first base, the end frames being thereby pivotable from a shipping position against the first base, a first loading position with the end frames pivoted outwardly of the respective end, a second loading position with the end frame pivoted outwardly of the first base remote from the respective end and towards the opposing end of the first base, and an erected position with the side diagonal at all oblique angle to the first base and the frame member extending from the respective end of the first base for enclosing heavy durable goods between the first and second bases, whereby the end frames pivot between a knocked-down position lying against the supporting first base and an erected position extending in a first direction from the first base for containing heavy equipment between the first and second bases.

11. The frame container as recited in claim 10, wherein the first and second bases each comprises a plurality of spaced-apart parallel stringers and spaced-apart transverse members connected at opposing ends of the stringers and intermediate thereof.

12. The frame container as recited in claim 11, further comprising a plurality of receiving posts, each attached to a respective one of the opposing ends of the outermost stringers, for receiving a lower end of a respective one of the side posts.

13. The frame container as recited in claim 11, wherein each of the side posts defines an open end for receiving and connecting to a respective one of the receiving posts.

14. The frame container as recited in claim 10, wherein each end frame comprises opposing end transverse members interconnected by opposing side posts and crossed diagonal members extending between the opposing transverse members.

15. The frame container as recited in claim 10, wherein opposing distal end portions of the transverse members at the opposing ends of the base define recesses; and further comprising a pin extending from the side posts along a longitudinal axis thereof, whereby a first and a second one of the frame containers stack by engaging the pins in a vertically lower one of the frame containers in the recesses of a vertically higher one of the frame containers.

16. The frame container as recited in claim 10 wherein the second base comprises a closing frame dimensioned for receipt by the end frames opposing the first base.

17. The frame container as recited in claim 16, further comprising a pair of intermediate supports pivotally connected at a respective first end to opposing sides of the closing frame intermediate the end frames and connected at a respective second end to opposing sides of the first base.

18. The frame container as recited in claim 11, wherein the stringers, the transverse members, the transverse upper and lower end member, the support diagonals, and the side posts are wooden members.

19. The frame container as recited in claim 11, wherein the stringers, the transverse members, the transverse upper and lower end member, and the support diagonals are wooden members.

20. The frame container as recited in claim 11, wherein the side posts are elongate tubular members.

21. The frame container as recited in claim 10, wherein the first base comprises a pallet for supporting the heavy equipment within the container between the first and second bases.

22. A frame container for packing, shipping, and storing heavy articles, comprising:

a first base and an opposing second base, each having a plurality of spaced-apart parallel stringers connected by a plurality of spaced-apart transverse members at opposing ends and intermediate thereof;

opposing end frames each having a transverse first end member and a parallel opposing transverse second end member interconnected by at least one cross member and a pair of opposing side posts connected at distal ends to respective distal ends of the transverse first and second end members;

a pair of opposing side diagonal members joined to each end frame, said diagonal member each pinned in a first end portion to the first base for pivoting relative thereto and pinned in an opposing end portion to a respective one of the side posts near the connection with the first end member for pivoting of the end frame, whereby the end frames pivot between a knocked-down position lying against the first base and an erected position extending in a first direction from the first base and a distal portion of the end frames contacting the second base for containing heavy equipment therebetween.

23. The frame container as recited in claim 22, wherein opposing distal end portions of the transverse members at the opposing ends of the first base define recesses; and further comprising a pin extending from the side posts in a direction parallel to a longitudinal axis thereof, whereby a first and a second one of the frame containers stack by engaging the pins of a vertically lower one of the frame containers in the recesses of a vertically higher one of the frame containers.

24. The frame container as recited in claim 22, wherein the stringers, the transverse members, the transverse upper and lower end members, the support diagonals, and the side posts are wooden.

25. The frame container as recited in claim 22, further comprising a pair of intermediate supports pivotally connected at a respective first end to opposing sides of the second base intermediate the opposing ends thereof for pivoting and connecting at a respective second end to opposing sides of the first base.

26. The frame container as recited in claim 22, wherein the first base comprises a pallet for supporting the heavy equipment within the container between the first and second bases.

* * * * *

UNITED STATES PATENT AND TRADEMARK OFFICE

CERTIFICATE OF CORRECTION

PATENT NO. : 7,387,215 B1
APPLICATION NO. : 11/294993
DATED : June 17, 2008
INVENTOR(S) : John M. Grigsby, Sr.

It is certified that error appears in the above-identified patent and that said Letters Patent is hereby corrected as shown below:

On the Title Page, Item (60) Please insert
--Related U.S. Application Data
Continuation of Ser. No. 10/270,785, October 11, 2002, Pat. No. 7,011,223.--

In column 7, line 44, please change "all" to --an--.

Signed and Sealed this

Nineteenth Day of August, 2008

JON W. DUDAS
*Director of the United States Patent and Trademark Office*